US006139672A

United States Patent [19]

Sato et al.

[11] Patent Number: 6,139,672

[45] Date of Patent: Oct. 31, 2000

[54] IMAGE-TRANSFER MEDIUM FOR INK-JET RECORDING AND IMAGE-TRANSFER PRINTING PROCESS

[75] Inventors: Yuko Sato, Kawasaki; Masato Katayama, Yokohama; Masahiko Higuma, Togane; Yoshiyuki Shino, Kawasaki, all of Japan

[73] Assignee: Canon Kabushiki Kaisha, Tokyo, Japan

[21] Appl. No.: 09/083,390

[22] Filed: May 22, 1998

[30] Foreign Application Priority Data

| | | | |
|---|---|---|---|
| May 30, 1997 | [JP] | Japan | 9-156075 |
| Jul. 26, 1997 | [JP] | Japan | 9-215661 |
| Jul. 26, 1997 | [JP] | Japan | 9-215664 |

[51] Int. Cl.[7] ..... B41M 5/00

[52] U.S. Cl. ..... 156/235; 428/195; 428/323; 428/327

[58] Field of Search ..... 428/195, 206, 428/207, 323, 327, 913, 914; 156/235

[56] References Cited

U.S. PATENT DOCUMENTS

| | | | |
|---|---|---|---|
| 4,785,313 | 11/1988 | Higuma et al. | 346/135.1 |
| 5,501,902 | 3/1996 | Kronzer | 428/323 |

FOREIGN PATENT DOCUMENTS

| | | |
|---|---|---|
| 0 805 049 A1 | 11/1997 | European Pat. Off. . |
| 8-207426 | 8/1996 | Japan . |
| 8-207450 | 8/1996 | Japan . |
| WO 97/01448 | 1/1997 | WIPO . |
| WO 97/18090 | 5/1997 | WIPO . |

*Primary Examiner*—Bruce H. Hess

*Attorney, Agent, or Firm*—Fitzpatrick, Cella, Harper & Scinto

[57] ABSTRACT

Disclosed herein is an image-transfer medium for ink-jet recording, comprising a base material, and a releasing layer and a transfer layer provided on the base material, wherein the transfer layer has fine particles of a thermoplastic resin, a thermoplastic resin binder, a cationic resin and inorganic fine particles, and the total content of the cationic resin and the inorganic fine particles falls within a range of from 3% to 20% by weight based on the total weight of the fine particles of the thermoplastic resin and the thermoplastic resin binder.

10 Claims, 1 Drawing Sheet

IMAGE-TRANSFER MEDIUM FOR INK-JET RECORDING AND IMAGE-TRANSFER PRINTING PROCESS

BACKGROUND OF THE INVENTION

1. Field of the Invention

The present invention relates to an image-transfer medium for ink-jet recording, which is suitable for use in forming an image on a transfer-printing medium such as cloth or film by transfer printing, and an ink-jet image-transfer printing process.

2. Related Background Art

An ink-jet recording method is intended to make a record of images, characters and the like by generating and ejecting droplets of an ink by any one of various ink ejection systems, for example, an electrostatic attraction system, a system in which a piezoelectric element is used to give an ink mechanical vibration or change, or a system in which an ink is heated to form bubbles in the ink so as to use the pressure thus produced, and applying a part or all of the droplets to a recording medium such as paper. The ink-jet recording method attracts attention as a recording system which scarcely produces noise and can conduct high-speed printing and color printing.

In recent years, ink-jet printers, by which full-color printing can be simply conducted as described above, have been spread, and there has thus been an increasing demand for conducting color printing on various media using these printers. In order to meet such a demand, particular attention is paid to printing techniques using a transfer printing system in that printing can be conducted irrespective of the form of recording media, namely, the formation of an image can be performed on any medium which does not permit direct printing by a printer.

Some image-transfer media making good use of an ink-jet recording system, which are used for printing processes through heat transfer or the like, have been proposed to date. For example, Japanese Patent Application Laid-Open No. 8-207426 has proposed an ink-jet recording sheet in which an ink-receiving layer is composed of a thermoplastic resin, a crystalline plasticizer and a tackifier, thereby permitting its sticking by heating alone. Japanese Patent Application Laid-Open No. 8-207450 has proposed an image-transfer medium comprising a base material layer and a heat transfer layer which is composed of a particulate thermoplastic resin, inorganic porous fine particles and a binder and permits ink-jet printing and heat transfer. U.S. Pat. No. 5,501,902 has proposed an image-transfer medium for ink-jet comprising a transfer layer of a structure that a cationic resin, an ink-viscosity adjuster and the like are added in addition to the above-described components.

These image-transfer media according to the prior art have sufficient performance as to formation of an image thereon by ink-jet recording and transfer printing of the image formed thereon. However, the performance as to fastness properties of such images transferred to various transfer-printing media has been yet insufficient. More specifically, when cloth to which an image was transferred from such an image-transfer medium as described above has been washed, the optical density of the image has been deteriorated by causes such as running out of coloring materials and fuzzing at the surface of the cloth having the transferred image.

SUMMARY OF THE INVENTION

Accordingly, it is an object of the present invention to provide an image-transfer medium for ink-jet recording, which has a high ink absorbency and permits the formation of a clear transferred image having high optical density and further the formation of a transferred image to various transfer-printing media such as cloth and film with excellent fastness properties.

Another object of the present invention is to provide an image-transfer medium for ink-jet recording, which permits the simple formation of a high-quality image excellent in fastness properties such as fastness to washing on various transfer-printing media such as cloth and film making good use of a general-purpose ink-jet printing system.

The above objects can be achieved by the present invention described below.

According to the present invention, there is thus provided an image-transfer medium for ink-jet recording, comprising a base material, and a releasing layer and a transfer layer provided on the base material, wherein the transfer layer has fine particles of a thermoplastic resin, a thermoplastic resin binder, a cationic resin and inorganic fine particles, and the total content of the cationic resin and the inorganic fine particles falls within a range of from 3% to 20% by weight based on the total weight of the fine particles of the thermoplastic resin and the thermoplastic resin binder.

According to the present invention, there is also provided an image-transfer printing process comprising the steps of forming an image on the transfer layer of the image-transfer medium described above in accordance with an ink-jet recording method, laying the image-transfer medium and a transfer-printing medium to overlap each other with the transfer layer on the side of the transfer-printing medium and heating them, and separating the base material of the image-transfer medium from the transfer-printing medium.

DESCRIPTION OF THE PREFERRED EMBODIMENTS

Figure 1:
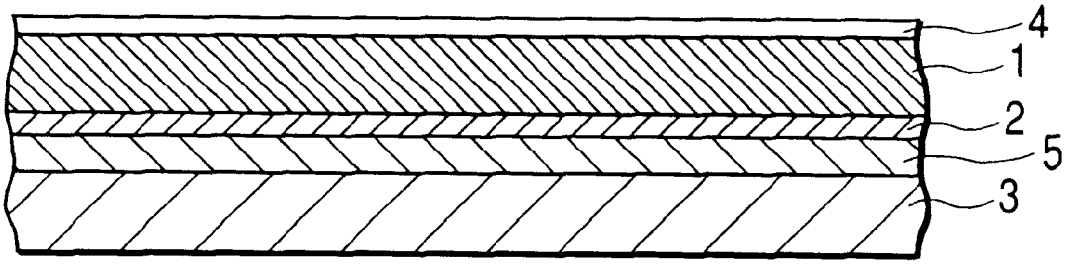
FIG. 1 illustrates an example of the image-transfer medium for ink-jet recording according to the present invention.

The image-transfer medium for ink-jet recording according to the present invention includes a releasing layer provided on a base material and a transfer layer provided on the transfer layer. In such a constitution, the transfer layer is required to satisfy the following three requirements.

First, the transfer layer must have a function of well absorbing inks for ink-jet recording to form a high-quality image and retaining the image formed.

Second, the transfer layer must have a function of adhering to a medium to be transferred (i.e., recording medium; hereinafter referred to as "transfer-printing medium") such as cloth or film to permit transfer of the image retained on the transfer layer to the transfer-printing medium in a satisfactory state.

Third, the transfer layer must have a function to strongly fix coloring materials present in the transfer layer to a transfer-printing medium such as cloth or film after transferred to the transfer-printing medium, thereby preventing deterioration of an image formed, which may be possibly caused when the cloth or the like, the transfer-printing medium, on which the image has been formed, is washed, or when the transfer-printing medium on which the image has been formed is wetted with water or sweat.

According to the present invention, an image-transfer medium for ink-jet recording having a transfer layer, which satisfies all the above-described functions, is provided. More specifically, in the present invention, fine particles of a thermoplastic resin, a thermoplastic resin binder, a cationic resin and inorganic fine particles are used as materials for forming the transfer layer, and the content of the cationic resin and inorganic fine particles is specified, thereby achieving all the performance requirements described above. The roles (functions) of the respective materials will hereinafter be described specifically.

The fine particles of the thermoplastic resin used in the present invention denote fine particles formed of a water-insoluble thermoplastic resin. Porous fine particles of the thermoplastic resin may preferably be used. When such fine particles of the thermoplastic resin are contained in a transfer layer, they are present in the transfer layer with the shape as the fine particles retained as they are, without forming a film before the formation of a transfer image, so that the transfer layer becomes a porous layer. Therefore, when inks are applied to the transfer layer by an ink-jet recording system, the inks can be satisfactorily absorbed in voids defined by the fine particles and retained therein. When the porous fine particles of the thermoplastic resin are used in this case, the inks are also absorbed in pores in the fine particles, so that the ink absorbency of the transfer layer can be more enhanced though detailed description will be made subsequently.

On the other hand, when an image formed on the transfer layer is brought into contact with a transfer-printing medium, and they are heated and pressed from the side of, for example, the base material of the image-transfer medium, thereby transferring the image to the transfer-printing medium, the fine particles of the thermoplastic resin in the transfer layer are melted together with the thermoplastic resin binder, whereby the transfer layer is transferred to the transfer-printing medium, and these fine particles are formed into a film. As a result, it is possible to satisfactorily fix coloring materials to the transfer-printing medium such as cloth or film. In this case, the thermoplastic resin is present in a state of fine particles in the transfer layer before melted. Therefore, when the transfer layer is transferred to, for example, a cloth, these fine particles penetrate between fibers of the cloth and are melted in a state that they surround the fiber, and the coloring materials are fixed thereafter. Accordingly, a beautiful transferred image can be provided without exposing the color of the underlying fibers even when the cloth is stretched.

When the transfer layer is formed by the above-described two materials alone, however, there has been a problem that the optical density of the resulting image is lowered because the transfer layer penetrates into the cloth in excess, and the coloring materials also penetrate deeply. There has also been a problem that the surface of the cloth is fuzzed by the same factor when the cloth is washed, and so the optical density of the resulting image is lowered. Therefore, the present inventors have carried out an extensive investigation with a view toward solving these problems. As a result, it has been found that when inorganic particles are added to the transfer layer, the phenomenon that the transfer layer penetrates into the cloth in excess can be effectively prevented, and so the above problems can be solved. More specifically, the addition of the inorganic particles having no melt property under heat to the transfer layer can prevent the thermoplastic resin making up the transfer layer from penetrating into the cloth in excess, so that a film can be formed on the surface of the cloth, and a clear image having high optical density can be provided. After that manner, fibers are also bonded on the surface of the cloth, and so the cloth can be prevented from being fuzzed by its washing, resulting in an image having high fastness to washing.

In the present invention, a cationic resin is additionally added to the materials for forming the transfer layer, thereby permitting the provision of a transferred image having higher fastness properties. Coloring materials commonly used in ink-jet printers are dyes. Such a coloring material is taken together into the transfer-printing medium when the fine particles of the thermoplastic resin and the binder are melted by heat at the time of transfer printing, and fixed to the transfer-printing medium such as cloth or film. However, the film thus formed may not become completely even in some case. In such a case, the dye may possibly exude when the cloth is immersed in water upon, for example, washing. When the cationic resin is added to the transfer layer, however, it is reacted with the dye to insolubilize the dye, whereby the dye can be prevented from dissolving out.

In the present invention, it is however necessary to control the total content of the inorganic particles and cationic resin having such respective functions as described above within a range of from 3% to 20% by weight based on the total weight of the fine particles of the thermoplastic resin and the thermoplastic resin binder. As described above, the inorganic particles are not melted under heat, nor do they have adhesion to the cloth. Since the cationic resin is generally water-soluble in many cases, it has no adhesion to the cloth, and is dissolved out in water upon washing when it is added more than the transfer layer needs, which may form the cause that the fastness properties are deteriorated.

Namely, these materials having no adhesive property to the cloth can exhibit their effects only in the state that they are taken into a material such as a thermoplastic resin having good adhesion to the cloth. However, the addition of such materials in excess impairs the adhesion of the transfer layer to the cloth, which may rather form the main cause that the fastness properties of the transferred image are adversely affected. From this reason, it is considered that the addition of the inorganic particles and cationic resin having no adhesion to the cloth to the transfer layer must be limited within a range of from 3% to 20% by weight based on the total weight of the fine particles of the thermoplastic resin and resin binder having good adhesive property to the cloth.

The image-transfer medium for ink-jet recording according to the present invention has a releasing layer together with the transfer layer of such a constitution as described above. The presence of the releasing layer allows to efficiently and easily transfer the transfer layer having the excellent properties described above to a transfer-printing medium such as cloth or film. For example, it can be prevented that the transfer layer is separated from the cloth together with a base material when it is separated and removed from the cloth after the transfer layer is transferred to the cloth by heating and pressing, or that a part of the transfer layer remains on the base material without being transferred, so that the image is impaired.

According to another embodiment of the present invention, a layer composed of a uniform film (hereinafter referred to as "uniform film layer") may be provided between the transfer layer and the releasing layer, which have been described above, to provide the transfer layer as a layer of a two-layer structure. The provision of this uniform film layer has the following two advantages.

First, the transfer layer can be formed on the releasing layer with more easy. In the image-transfer medium for ink-jet recording according to the present invention, as described above, it is preferable to provide a porous transfer layer for the purpose of improving its ink absorbency. When the porous layer is provided on a layer having low adhesion, such as the releasing layer, however, the adhesion between these layers becomes poor, so that in some cases, the transfer layer may be separated from the releasing layer upon handling of the resulting image-transfer medium. Accordingly, when a transfer layer is made up of two layers in such a manner that the uniform film layer, which is not porous, is situated on the side of the releasing layer, the adhesion between the transfer layer and the releasing layer is improved, and so such a problem is hard to arise.

Second, when the uniform film layer is provided between the transfer layer and the releasing layer, the fastness to washing of the image transferred to cloth or the like can be more improved. More specifically, when the transfer layer is made up of two layers, the uniform film layer becomes a face layer to cover the surface of the image after transfer printing. Therefore, it is considered that the coloring materials are closely fixed to the cloth in a state that they are more shielded in the transfer layer, and the fastness properties are hence enhanced.

It is more preferable that a material of the same kind as the thermoplastic resin used as a material for forming the above-described transfer layer be used as a material for forming the uniform film layer. More specifically, when materials of the same kind are used as materials for forming these two layers, adhesion between the two layers can be enhanced, and so the fastness properties of the image transferred can be more improved. Further, since a difference in refractive index between the two layers becomes small, the transfer layer after transfer printing becomes transparent, and so a clear image can be provided.

The individual components used for the image-transfer media for ink-jet recording according to the present invention and having the above-described respective roles will hereinafter be described more specifically.

As the fine particles of the thermoplastic resin used in forming the transfer layer, any fine particles may be used so far as they are fine particles formed of a water-insoluble thermoplastic resin. Examples of such a thermoplastic resin include polyethylene, polypropylene, polyvinyl acetate, polyvinyl alcohol, polyvinyl acetal, poly(meth)acrylic acid, poly(meth)acrylates, polyacrylic acid derivatives, polyacrylamide, polyether, polyester, polycarbonate, cellulosic resins, polyacrylonitrile, polyimide, polyamide, polyvinyl chloride, polyvinylidene chloride, polystyrene, Thiokol, polysulfone, polyurethane and copolymer of these resins. Among others, polyethylene, polypropylene, poly (meth)acrylic acid, poly(meth)acrylates, polyvinyl acetate, polyvinyl chloride, polyurethane, polyamide and copolymers thereof are more preferably used. A copolymer of a monomer of nylon 6 and a monomer of nylon 12, i.e., nylon 612, is particularly preferred.

The particle size of the fine particles of the thermoplastic resin used in the present invention is preferably within a range of from 0.05 to 100 $\mu$m, more preferably from 0.2 to 50 $\mu$m, most preferably from 5 to 20 $\mu$m from the viewpoints of the ink absorbency of the resulting transfer layer and the clearness of the resulting image. If resin particles having a particle size smaller than 0.05 $\mu$m are used, interparticle voids become too small upon the formation of the transfer layer, and so the resulting transfer layer comes to have insufficient ink absorbency. Further, if the particles are too small, the smoothness of the surface of the resulting transfer layer becomes high, so that the transfer layer becomes hard to penetrate into the fibers of cloth, and an image transferred to the cloth tends to be formed as an even continuous film on the surface of the cloth. As a result, the transferred image becomes easy to be separated, and the transfer layer cracks to expose the underlying fibers when the cloth is stretched. Therefore, it is difficult to provide any satisfactory transferred image.

As the fine particles of the thermoplastic resin used in the present invention and formed of any of the above-mentioned materials, porous fine particles may preferably be used. When the porous fine particles of the thermoplastic resin are used in the transfer layer in the present invention, the ink absorbency of the transfer layer can be more enhanced, so that a greater amount of ink can be absorbed by a layer thinner in thickness, resulting in a thin transfer layer which permits the formation of a clear image. Further, such provision of the thin transfer layer not only permits transferring an image with more ease, but also makes the hand-feeling of the image transferred on cloth or the like soft, so that a more preferable image-transferred article can be provided. In the present invention, it is particularly preferable to use, as the material for forming the transfer layer, fine particles of a thermoplastic resin composed of a copolymer of nylon 6 and nylon 12. When such fine particles are used, the coloring ability of dyes becomes better, and so a clearer image can be provided.

As the material for the fine particles of the thermoplastic resin used in the present invention, it is preferable to use a material capable of being sufficiently melted by a household iron or the like so as to be able to simply transfer an image formed on the resulting transfer layer by means of a general-purpose ink-jet printer to cloth in a home or the like. Taking this regard into consideration, a resin having a melting point ranging from 70 to 200° C., preferably from 80 to 180° C., more preferably from 100 to 150° C. is used as the material for the fine particles of the thermoplastic resin. More specifically, when a material for the fine particles of the thermoplastic resin having a melting point lower than 70° C. is used, the fine particles of the thermoplastic resin in the transfer layer may possibly form a continuous film according to conditions where the resulting image-transfer medium is shipped or stored, so that there is a possibility that the ink absorbency of the transfer layer may be deteriorated. After coating the base material with the fine particles of the thermoplastic resin, it is necessary to dry the coating formed of the fine particles of the thermoplastic resin at a temperature lower than the melting point of the thermoplastic resin. It is thus preferable to use the thermoplastic resin having a melting point of at least 70° C. for the purpose of facilitating the drying from the viewpoint of production efficiency. On the other hand, if a material for the fine particles of the thermoplastic resin having a melting point higher than 200° C. is used, higher energy is required for transferring the resulting image to cloth. It is hence difficult to form simply a transferred image to a transfer-printing medium such as cloth or film, which is an object of the present invention.

Taking the adhesion of the transfer layer to the cloth into consideration, it is also preferable to use a material for the fine particles of the thermoplastic resin having a low melt viscosity. When the melt viscosity of the resulting fine particles of the thermoplastic resin is high, the adhesion between the transfer layer and the cloth becomes poor, so that the transfer layer in the form of a continuous film is easy to be separated. However, when the material having a low melt viscosity is used, the fine particles of the thermoplastic resin in the transfer layer become easy to penetrate into fibers upon transfer, thereby providing a good transferred image wherein the color of the underlying fibers is not exposed even when the cloth is stretched after the transfer. Besides, by adding a plasticizer for the fine particles of the thermoplastic resin or a plasticizer for the thermoplastic resin binder into the transfer layer, the melt viscosity of the transfer layer can be made low upon its transfer, i.e., its heating, so that the adhesion of the transfer layer to the cloth can be more enhanced, and the transferability thereof can be improved.

In order not to impair the hand-feeling of the cloth as much as possible after forming a transferred image, it is preferable to use a film-forming material, which can give a film having high flexibility after melting the transfer layer. Even in this sense, it is preferable to add the plasticizer for the fine particles of the thermoplastic resin or the plasticizer for the thermoplastic resin binder into the transfer layer. In such a manner, both strength and flexibility can be imparted to the resulting transfer image, and so it is possible to form a transferred image having an excellent hand-feeling to a transfer-printing medium such as cloth or film.

The thermoplastic resin binder, which is used as a material for forming the transfer layer together with the fine particles of the thermoplastic resin, will now be described. The binder is added into the transfer layer for the purpose of bonding the fine particles of the thermoplastic resin to one another and of fixing the transfer layer, on which a transfer image has been formed, to a transfer-printing medium such as cloth at the time of transferring an image. As with the fine particles of the thermoplastic resin described above, any conventionally known water-insoluble thermoplastic resin may be used as the thermoplastic resin for the binder. Specifically, those mentioned above as the materials for the fine particles of the thermoplastic resin may be used. The thermoplastic resins used for the fine particles of the thermoplastic resin and the thermoplastic resin binder have no cationic nature.

In the present invention, a weight ratio of the fine particles of the thermoplastic resin to the thermoplastic resin binder is preferably within a range of from 1/2 to 50/1, more preferably from 1/2 to 20/1, most preferably from 1/2 to 15/1. If the proportion of the fine particles of the thermoplastic resin is too high, adhesion among the fine particles of the thermoplastic resin or between the fine particles and the releasing layer becomes insufficient, and it is hence impossible to form a transfer layer having sufficient strength before its transfer. On the other hand, if the proportion is too low, it is difficult to provide any transfer layer having excellent ink absorbency and permitting the formation of a transferred image having excellent clearness.

The material for the cationic resin used in the transfer layer by adding to the fine particles of the thermoplastic resin and the binder will now be described. As described above, the cationic resin is added for the purpose of insolubilizing a dye in an ink in water. Examples of the cationic resin include the following resins:

cationically modified products of resins such as polyvinyl alcohol, hydroxyethyl cellulose and polyvinyl pyrrolidone;

polymers and copolymers of amine monomers such as allylamine, diallylamine and diallyldimethylammonium chloride, of allyl sulfone, dimethylallyl sulfone, and of acrylic monomers having a primary, secondary or tertiary amine, or quaternary ammonium base at their side chains, such as dimethylaminoethyl (meth)acrylate, diethylaminoethyl (meth)acrylate, methylethylaminoethyl (meth) acrylate, dimethylaminostyrene, diethylaminostyrene, methylethylaminostyrene, N-methylacrylamide, N-dimethyl acrylamide, N,N-diemthylaminoethyl methacrylamide and quaternized compounds thereof; and resins having a primary, secondary or tertiary amine, or quaternary ammonium base at their main chains.

The inorganic particles used together with the cationic resin in the transfer layer will now be described. No particular limitation is imposed on the inorganic particles used in the present invention so far as they are porous and have good ink absorbency. Specific examples thereof include silica, aluminum silicate, magnesium silicate, hydrotalcite, calcium carbonate, titanium oxide, clay, talc and (basic) magnesium carbonate.

Of these, a material having high dyeing property may preferably be used, since a dye in an ink is fixed to a portion nearer the surface of a transfer-printing medium such as cloth. When a material having a higher void volume is used in this case, the ink absorbency of the resulting transfer layer is also enhanced, and so a clearer image can be provided. The particle size of the inorganic particles used in the present invention is preferably close to that of the fine particles of the thermoplastic resin described above as much as possible. The reason for it is that when articles different in particle size are added to each other, particles having a smaller diameter are filled in interparticle voids of particles having a greater diameter, so that the voids of the resulting transfer layer are reduced.

As described above, the total amount of the inorganic particles and cationic resin added to the transfer layer must be limited within a range of from 3% to 20% by weight based on the total weight of the fine particles of the thermoplastic resin and the thermoplastic resin binder. This is considered to come from the following reason. The fine particles of the thermoplastic resin are not melted by heat nor have adhesion to cloth, and the cationic resin has no adhesion to the cloth and is generally a water-soluble resin in many cases. Therefore, when the cationic resin is dissolved out in water upon washing when it is added more than the transfer layer needs, which may form the cause that fastness properties are deteriorated. Accordingly, these materials having no adhesion to the cloth can exhibit their effects only in the state that they are taken into a material such as the thermoplastic resin having good adhesion to the cloth, and so the addition of such materials in excess impairs the adhesion between the transfer layer and the cloth, which may rather form the main cause that the fastness properties of the transferred image are adversely affected.

A weight ratio of the inorganic particles to the cationic resin is preferably within a range of from 1/1 to 1/20, more preferably from 1/2 to 1/10, most preferably from 1/2 to 1/5.

More specifically, if the inorganic particles are added in a proportion higher than this ratio, the transferability of the resulting transfer layer is adversely affected, and the effect of the cationic resin is lessened, so that the fastness properties of the transferred image are deteriorated. If the proportion of the inorganic particles is lower than the above ratio on the other hand, it is impossible to control the penetration of the resulting transfer layer into the cloth, which also forms the main cause that the fastness properties are deteriorated.

The film thickness of the transfer layer formed by such materials as described above is preferably within a range of from 10 to 150 $\mu$m, more preferably from 30 to 120 $\mu$, most preferably from 40 to 100 $\mu$m. If the transfer layer is too thick, any flexible image cannot be formed on a transfer-printing medium such as cloth when the transfer layer with an image is transferred thereto. If the transfer layer is too thin on the other hand, a transferred image to be formed becomes deteriorated in image quality or fastness properties. It is hence not preferable to form the transfer layer too thick or too thin.

A surfactant may be additionally contained in the transfer layer in the image-transfer medium for ink-jet according to the present invention for the purpose of improving its permeability to inks. More specifically, when the surfactant is added into the transfer layer, the wettability of the surfaces of the particles contained in the transfer layer is improved, and so the permeability to water-based inks is enhanced. In the present invention, any of nonionic surfactants commonly used may be used as the surfactant. More specifically, surfactants of the ether, ester, ether-ester, nitrogen-containing and fluorine-containing types may be used.

Description will hereinafter be given as to another embodiment of the transfer layer of the image-transfer medium for ink-jet recording according to the present invention, wherein the transfer layer is made up of two layers as described above, namely, a uniform film layer is provided between the transfer layer and the releasing layer. According to such an embodiment, the adhesion between the releasing layer and the transfer layer can be improved, and so a problem that the transfer layer is separated from the releasing layer in such cases as conveyed in a printer can be more improved. In addition, since the uniform film layer becomes a face layer after transfer printing, coloring materials in inks are kept in a state that they are shielded without exposing them, and the transfer layer can be firmly fixed to the cloth, and so the fastness properties of the resulting image are more enhanced. It is preferable that a material of the same kind as the material used for the thermoplastic resin binder be used as a material for forming the uniform film layer. The thickness of the uniform film layer is preferably made thinner than the transfer layer, e.g., within a range of from 1 to 50 $\mu$m.

To each transfer layer of the image-transfer media for ink-jet recording according to the present invention, may be added additives in addition to the above-described components. It is particularly effective to add a plasticizer for the fine particles of the thermoplastic resin or the thermoplastic resin binder into the transfer layer from the viewpoint of enhancing transferability. By adding the plasticizer, the melt viscosity of the transfer layer becomes low upon its transfer, i.e., its heating, so that its adhesion to cloth can be more enhanced, and the transferability is improved. In addition, the flexibility and strength of a transferred image to be formed can be improved. When the plasticizer is used, it is preferably added in a proportion of from 1 to 20% by weight based on the total weight of the transfer layer.

As the plasticizer used in this case, may be used any conventionally known plasticizer. Specific examples thereof include phthalates such as diethyl phthalate, dioctyl phthalate, dimethyl phthalate and dibutyl phthalate, phosphates such as tributyl phosphate and triphenyl phosphate, adipates such as octyl adipate and isononyl adipate, sebacates such as dibutyl sebacate and dioctyl sebacate, acetyltributyl citrate, acetyltriethyl citrate, dibutyl maleate, diethylhexyl maleate, dibutyl fumarate, trimellitic acid type plasticizers, polyester type plasticizers, epoxy type plasticizers, stearin type plasticizers, and chlorinated paraffins, toluenesulfonamide and derivatives thereof, and 2-ethylhexyl p-hydroxybenzoate In the present invention, 1.0 to 5.0% by weight of a fluorine-containing surfactant may be added to the transfer layer, thereby preventing occurrence of color irregularity upon formation of an image. If the fluorine-containing surfactant is added in an amount smaller than the lower limit of the above range, the occurrence of color irregularity cannot be prevented. If the fluorine-containing surfactant is added in an amount greater than the upper limit on the other hand, the fine particles of the thermoplastic resin become hard to be fusion-bonded to one another upon transfer printing, so that a problem of failure in transfer arises on the resulting transfer layer. Accordingly, in the present invention, the fluorine-containing surfactant is added in the amount within the above-described range, whereby the occurrence of color irregularity upon formation of an image on the resulting image-transfer medium after it has been stored or left to stand for a long period of time at a high temperature or humidity can be prevented with good result.

Preferable examples of the fluorine-containing surfactant include fluoro-$C_2$–$C_{10}$-alkylcarboxylic acids, disodium N-perfluorooctanesulfonylglutamate, sodium 3-[fluoro-$C_6$–$C_{11}$-alkyloxy]-1-$C_3$–$C_4$-alkylsulfonate, sodium 3-[ω-fluoro-$C_6$–$C_8$-alkanoyl-N-ethylamino]-1-propanesulfonate, N-[3-(perfluorooctanesulfonamido)propyl]-N,N-diemthyl-N-carboxymethyleneammonium betaine, fluoro-$C_{11}$–$C_{20}$-alkylcarboxylic acids, perfluoro-$C_7$–$C_{13}$-alkylcarboxylic acids, perfluorooctanesulfonic acid diethanolamide, perfluoro-$C_4$–$C_{12}$-alkylsulfonic acid salts (Li, K and Na salts), N-propyl-N-(2-hydroxyethyl)perfluorooctane sulfonamide, perfluoro-$C_6$–$C_{10}$-alkyl sulfonamide propyltrimethylammonium salts, perfluoro-$C_6$–$C_{10}$-alkyl-N-ethylsulfonyl glycine salt (K salt), bis(N-perfluorooctylsulfonyl-N-ethylaminoethyl) phosphate, monoperfluoro-$C_6$–$C_{16}$-alkylethyl phosphates and perfluoroalkylbetaines.

The releasing layer making up the image-transfer medium for ink-jet recording according to the present invention together with the transfer layer having such constitution as described above has an effect of facilitating the separation of the transfer layer from the base material when the transfer layer is transferred to a transfer-printing medium such as cloth or film.

Examples of a material for forming the releasing layer include hot-melt materials, for example, waxes such as carnauba wax, paraffin wax, microcrystalline wax and castor wax, higher fatty acids and derivatives thereof such as metal salts and esters, for example, stearic acid, palmitic acid, lauric acid, aluminum stearate, lead stearate, barium stearate, zinc stearate, zinc palmitate, methyl hydroxystearate and glycerol monohydroxystearate, polyamide resins, petroleum resins, rosin derivatives, coumarone-indene resins, terpene resins, novolak resins, styrene resins, olefin resins such as polyethylene, polypropylene, polybutene and polyolefin oxide, and vinyl ether resins. Besides, silicone resins, fluorosilicone resins, fluoroolefin-vinyl ether copolymers, perfluoroepoxy resins, thermosetting acrylic resins having perfluoroalkyl groups at their side chains, and vinylidene fluoride type hardening resins may also be preferably used. The coating weight of a coating formulation composed of any of these materials is preferably within a range of from 0.01 g/m$^2$ to 10.0 g/m$^2$.

In the image-transfer media for ink-jet recording according to the present invention, the releasing layer composed of such a material as described above is formed on a base material. As the base material used in the present invention, any base material may be used so far as it can be conveyed in printers and has sufficient heat resistance to withstand a heat transfer treatment. Specific examples thereof include films of polyester, diacetate resins, triacetate resins, acrylic polymers, polycarbonate, polyvinyl chloride, polyimide, cellophane and celluloid, paper, and cloth and nonwoven fabrics formed of various kinds of fibers. The image-transfer media for ink-jet recording according to the present invention can be fitted to the shape of a transfer-printing medium even if the transfer-printing medium would have a curved surface, when a flexible material such as paper, cloth or nonwoven fabric is used as a base material, so that an image can be satisfactorily transferred to media other than flat media.

Figure 2:
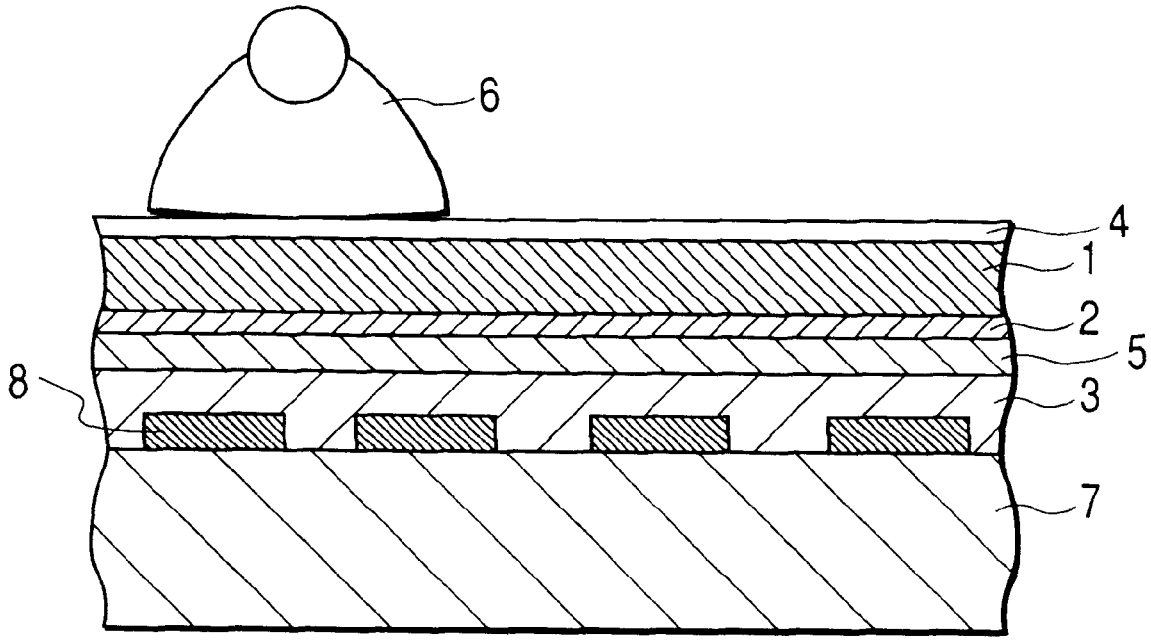
FIG. 2 illustrates an example of the image-transfer printing process using the image-transfer medium for ink-jet recording according to the present invention.

According to an embodiment of the present invention, as illustrated in FIG. 1, the image-transfer medium for ink-jet recording may be provided with a layer 4 having water repellency and lubricity (hereinafter referred to as "water-repellent lubricant layer") on the opposite side (hereinafter may be referred to as "back surface") of the base material 1 to the side on which the releasing layer 2 and the transfer layer 3 have been provided. The image-transfer medium of such a constitution according to the present invention can be smoothly heated and pressed by the use of, for example, a household iron 6 from the side of the water-repellent lubricant layer 4 on the base material 1 as illustrated in FIG. 2, after a desired image 8 is formed on the transfer layer 3 by an ink-jet recording method and a transfer-printing medium such as a cloth 7 is laid to overlap the transfer layer 3, thereby transferring the image 8. As a result, the whole surface of the transfer layer can be evenly heated, so that a problem of failure in transfer due to insufficient heating can be prevented from arising.

In FIGS. 1 and 2, an example where a transparent uniform film layer 5 is provided between the releasing layer 2 and the transfer layer 3 is illustrated. In the present invention, however, it is not essential to provide such a film layer 5. However, the provision of such a uniform film layer 5 is preferred because the uniform film layer 5 functions as a protective layer for the image transferred to the cloth 7.

The water-repellent lubricant layer 4 may also be effective for the prevention of curling. Particularly, in an image-transfer medium in which the base material 1 is paper and the transfer layer 3 is formed on only one side thereof, a phenomenon that the porous paper base absorbs or emits moisture according to change in ambient humidity and so the image-transfer medium is curled tends to occur. Such curling can be prevented by the water-repellent lubricant layer 4.

The image-transfer medium for ink-jet recording according to one embodiment of the present invention features that the layer having water repellency and lubricity is provided on the opposite side of the base material to the side on which the releasing layer and the transfer layer have been provided. Since such a layer is heated in a transfer step as described above, it is preferable to use a heat-resistant material as a material for forming the water-repellent lubricant layer. Preferable examples of a method for forming the water-repellent lubricant layer include the following methods:

(1) a method of forming a water-repellent lubricant layer from a heat-resistant resin containing a lubricant or release agent; and (2) a method of forming a water-repellent lubricant layer from a silicone resin, fluororesin or copolymer having these resin segments.

However, the present invention is not limited to these methods. For example, a method in which release paper both sides of which have been already subjected to a releasing treatment is used as a base material, or a method in which a film composed of a water-repellent lubricant material is laminated on the back surface of a base material to form a water-repellent lubricant layer may also be used.

A specific preferable example of the method (1) includes a method in which a coating formulation containing a composition obtained by incorporating a lubricant or release agent into a resin having relatively excellent heat resistance, for example, an acrylic resin such as polymethyl methacrylate, acetal resin, polycarbonate resin, aromatic polyester resin, aromatic polyamide resin, or polyimide resin is prepared, and the coating formulation is coated on the back surface of a base material to form a film. Examples of the lubricant or release agent used in this case include aliphatic hydrocarbon compounds, higher aliphatic alcohols, fatty acid amide compounds, metallic soaps of higher fatty acids, higher fatty acid esters, waxes, plasticizers, various kinds of surfactants, silicone oil and fluororesin type oil. These lubricants or release agents are preferably used in a proportion ranging from 5 to 100 parts by weight per 100 parts by weight of the heat-resistant resin.

The method (2) is a method of using a resin having water repellency and lubricity in itself to form a water-repellent lubricant layer. Specifically, a material such as, for example, a silicone resin, fluororesin or block copolymer of a silicone or fluororesin segment and a segment of another resin, is used to form a film as a water-repellent lubricant layer on the back surface of a base material. It goes without saying that a suitable amount of such a lubricant or release agent as described above may be added into these resins upon the formation of the water-repellent lubricant layer.

In the case where the water-repellent lubricant layer is formed on the back surface of the base material in the above-described manner, it is preferable to select and use a heat-resistant resin having a melting point or softening point higher than the transfer temperature of the transfer layer.

A mechanism that ironing can be smoothly conducted will be described briefly. Since the water-repellent lubricant layer formed by the method (1) is formed from the heat-resistant resin containing the lubricant or release agent, the heat-resistant resin is not melted even when the image-transfer medium is heated by an iron or the like from the side of the water-repellent lubricant layer in a transfer step, so that the water-repellent lubricant layer does not weld to the heating surface of the iron. On the other hand, the low-melting lubricant or release agent dispersed in the heat-resistant resin is fused upon the heating by the iron and exudes out of the surface of the water-repellent lubricant layer, and so the iron can be slid smoothly. Alternatively, in the case of the water-repellent lubricant layer composed of the silicone resin, fluororesin or copolymer having these resin segments formed by the method (2), the resin itself is heat-resistant and has water repellency and lubricity. Therefore, the water-repellent lubricant layer does not weld to the heating surface of the iron, and so the iron can be slid smoothly.

The water-repellent lubricant layer to be formed in the above-described manner is preferably formed in such a manner that the dry coating weight of the coating formulation is of the order of from 0.1 to 2 $g/m^2$. The water-repellent lubricant layer expressed as the layer having water repellency and lubricity in the present invention is preferably in a state of a uniform film layer. In the present invention, however, it does not particularly denote such a layer alone. A state that a substance having water repellency and lubricity is distributed on the back surface of the base material may also be allowed so far as the curling of the resulting image-transfer medium can be prevented, and lubricity can be imparted to the back surface of the base material.

According to a preferred embodiment of the present invention, the water-repellent lubricant layer may be formed with a coating formulation containing the so-called temperature indicating material the visual appreciation of which changes according to temperature change. When the water-repellent lubricant layer is formed with the coating formulation containing the temperature indicating material, an area of the water-repellent lubricant layer that has been heated by an iron can be distinguished with the naked eyes, and so the whole surface of the transfer layer can be evenly heated with higher reliability by a household iron. The temperature indicating material itself is a known material, and either of an irreversible or quasi-irreversible temperature indicating material or a reversible temperature indicating material may be used. Of these, the irreversible temperature indicating material is particularly preferably used in order to clearly grasp the state of transfer.

Examples of the irreversible temperature indicating material include various kinds of temperature indicating materials the visual appreciation of which clearly changes according to physical or chemical change, such as thermal decomposition system, sublimate development system, chemical reaction system, melt development system, electron transfer system and pH change system. Specific examples of temperature indicating materials usable in the present invention include salts of metals such as cobalt, nickel, iron, copper, chromium and manganese, mixtures of two kinds of coloring matter different in hue, one of which sublimates at a specific temperature, mixtures of bismuth oxide and bismuth sulfide, materials the visual appreciation of which changes by melting, dispersions of a leuco dye and a phenolic compound (heat-sensitive color-developing dyes), and mixture of an organic acid and phenolphthalein.

The above-described examples are preferred examples, and besides various kinds of coloring matter, which are conventionally known dyes and pigments the visual appreciation of which changes at a temperature somewhat higher than the transfer temperature may also be used.

Processes for forming the releasing layer and the transfer layer, and optionally the uniform film layer and the water-repellent lubricant layer on the base material include a process in which the respective suitable materials described above are dissolved or dispersed in a suitable solvent to prepare respective coating formulations, and the coating formulations are coated on a base material or another layer, a process in which films are separately formed with these materials, and the films are laminated on a base material or another layer, and a process in which films are extruded on a base material to laminate them on one another. Examples of a coating method include a roll coater, blade coater, air knife coater, gate roll coater, bar coater, size pressing, Symsizer, spray coating, gravure coating and curtain coater methods.

A process for forming an image on a transfer-printing medium such as cloth using the image-transfer medium according to the present invention will hereinafter be described.

First of all, an image is formed on the transfer layer of the image-transfer medium according to the present invention by an ink-jet recording method. The image-transfer medium according to the present invention and a transfer-printing medium are then laid to overlap each other with the transfer layer on the side of the transfer-printing medium and heated by an iron or hot press from the side of the base material of the image-transfer medium. Finally, the base material of the image-transfer medium is separated from the transfer-printing medium to transfer the transfer layer to the transfer-printing medium.

As an ink-jet printer, any commercially available ink-jet printer commonly used may be employed as it is. No particular limitation is also imposed on coloring materials to be used. For example, conventionally known anionic coloring materials may be used. It is not necessary to specially change the kind of coloring materials according to materials making up cloth.

No particular limitation is also imposed on materials making up cloth used in the present invention. For example, any of cotton, hemp, silk, wool, rayon, polyester, nylon, acrylic, acetate, triacetate and polyurethane, and blended fibers thereof may be used. The cloth may be used in any form of a woven fabric, a knitted fabric and a nonwoven fabric.

The present invention will hereinafter be described more specifically by the following Examples and Comparative Example. Incidentally, all designations of "part" or "parts" and "%" as will be used in the following examples mean part or parts by weight and % by weight unless expressly noted.

EXAMPLES 1 TO 8 AND COMPARATIVE EXAMPLES 1 AND 2

Details of materials used in the Examples and Comparative Examples are shown in Table 1. Of these, materials a to j were first used in various combinations shown in Table 2, and the respective materials were thoroughly mixed to prepare coating formulations A to K.

TABLE 1

Materials for forming image-transfer media used in examples

| | Code No. | Name of chemical substance | Trade name |
|---|---|---|---|
| Fine particles of thermoplastic resin | a | Ethylene-vinyl acetate copolymer emulsion | Chemipearl V-300 (solid content: 40%, particle size: 6 μm; product of Mitsui Petrochemical Industries, Ltd. |
| | b | Porous fine particles of nylon resin | Orgasol 3501EDX NAT (particle size: 10 μm; product of Elf Atochem S.A.) |
| Thermoplastic resin binder | c | Ethylene-acrylic acid copolymer emulsion | Hitec E-8778 (solid content: 25%; product of Toho Chemical Industry Co., Ltd.) |
| | d | Urethane resin emulsion | Takelac W-635c (solid content: 35%; product of Takeda Chemical Industries, Ltd.) |
| Inorganic fine particles | e | Silica | Mizukasil P-78A (particle size: 3 μm; product of Mizusawa Industrial Chemicals, Ltd.) |
| | f | Alumina | AKP-15 (particle size: 0.74 μm; product of Sumitomo Chemical Co., Ltd.) |
| Cationic resin | g | Acrylic cationic resin | EL Polymer NWS-16 (solid content: 35%; product of Shin-Nakamura Chemical Co., Ltd.) |
| | h | Polyallylamine | PAA-HCl-10L (solid content: 40%; product of Nitto Hoseki Co., Ltd.) |
| Plasticizer | i | N-Ethyl-o,p-toluene-sulfonamide | Topcizer No. 3 (product of Fuji Amide Chemical Co., Ltd.) |
| Surfactant | j | Fluorine-containing surfactant | Surflon S-131 (solid content: 30%; product of Seimi Chemical Co., Ltd.) |
| Base material | k | Release paper | ST-60 0KT-T (product of LINTEC Corp.) |

TABLE 2

| Coating formulation | Fine particles of thermoplastic resin Code | Parts | Thermoplastic resin binder Code | Parts | Inorganic fine particles (M) Code | Parts | Cationic resin (K) Code | Parts | Total of M + K Parts | Plasticizer Code | Parts | Surfactant Code | Parts | Water/IPA |
|---|---|---|---|---|---|---|---|---|---|---|---|---|---|---|
| A | a | 55 | c | 45 | e | 0.6 | g | 2.4 | 3.0 | — | — | — | — | 10 |
| B | a | 55 | c | 45 | e | 2.0 | g | 8.0 | 10.0 | — | — | — | — | 10 |
| C | a | 55 | c | 45 | e | 2.0 | g | 18.0 | 20.0 | — | — | — | — | 10 |
| D | a | 55 | c | 45 | — | 0.0 | — | 0.0 | 0.0 | — | — | — | — | 10 |
| E | a | 55 | c | 45 | e | 2.5 | g | 22.5 | 25.0 | — | — | — | — | 10 |
| F | a | 55 | c | 45 | e | 2.0 | g | 8.0 | 10.0 | — | — | — | — | 10 |
| G | b | 55 | c | 45 | e | 2.0 | g | 8.0 | 10.0 | i | 10 | — | — | 10 |
| H | b | 55 | d | 45 | f | 2.0 | h | 8.0 | 10.0 | i | 10 | — | — | 10 |
| I | b | 55 | c | 45 | e | 2.0 | g | 8.0 | 10.0 | i | 10 | j | 2 | 10 |
| J | b | 45 | c | 55 | e | 3.0 | g | 7.0 | 10.0 | i | 10 | j | 2 | 10 |
| K | b | 0.1 | c | 100 | — | 0.0 | — | 0.0 | 0.0 | — | — | — | — | 5 |

The coating formulations shown in Table 2 were applied under their corresponding conditions shown in Table 3 to obtain image-transfer media according to Examples 1 to 8 and Comparative Examples 1 and 2. In Table 3, each thickness is a value in terms of dry coating thickness. The coating was conducted by means of a bar coater method. In Example 8, the coating formulation K was used to form a uniform film having a thickness of 20 μm, and the coating formulation J was then coated thereon to form a transfer layer having a thickness of 50 μm.

TABLE 3

| | Base material | Transfer layer: Coating formulation | Coating thickness (μm) | Drying temp. (°C.) | Drying time (min) |
|---|---|---|---|---|---|
| Ex. 1 | k | A | 50 | 70 | 10 |
| Ex. 2 | k | B | 50 | 70 | 10 |
| Ex. 3 | k | C | 50 | 70 | 10 |
| Comp. Ex. 1 | k | D | 50 | 70 | 10 |
| Comp. Ex. 2 | k | E | 50 | 70 | 10 |
| Ex. 4 | k | F | 50 | 70 | 10 |
| Ex. 5 | k | G | 50 | 70 | 10 |
| Ex. 6 | k | H | 50 | 70 | 10 |
| Ex. 7 | k | I | 50 | 70 | 10 |
| Ex. 8 | k | J | 50 | 70 | 10 |
| | | K | 20 | 80 | 10 |

Printing was conducted on the thus-produced image-transfer media of Examples 1 to 8 and Comparative Examples 1 and 2 in accordance with a back printing film mode by means of an ink-jet color printer, BJC-600J (trade name, manufactured by Canon Inc.). After the printing, each of the printed image-transfer media was placed on a 100% cotton fabric for T-shirt with the transfer layer aligned with a portion of the fabric to be transferred. The transfer layer was transferred to the fabric by heating at about 190° C. by means of a hot press from the base material side of the image-transfer medium. The respective images thus transferred were evaluated as to image quality and fastness to washing in accordance with the following evaluation methods.

(1) Image Quality

Four patches (15 mm×15 mm) of different colors were printed adjoiningly to one another on the fabric for T-shirt, whereby evaluation was made by whether bleeding occurred or not at boundaries among the four colors.

More specifically, the colors of the patches were yellow of 100% duty, cyan of 100% duty, blue produced with cyan of 100% duty and magenta of 100% duty, and red produced with magenta of 100% duty and yellow of 100% duty in that order. The image transferred on the fabric for T-shirt was visually observed as to whether bleeding occurred or not at boundaries between the respective adjacent colors, thereby making evaluation.

As a result, in any of Examples 1 to 8 and Comparative Examples 1 and 2, the thus-obtained image was such that caused no problem in actual use. However, the following differences were found among their image qualities.

In Examples 4 to 8, no bleeding was observed at boundaries among all the colors. In Examples 2 and 3, and Comparative Example 1, bleeding was observed at a boundary between the secondary colors (blue and red), but the images were such that caused no problem in actual use.

In Example 1 and Comparative Example 2, bleeding was also observed at a boundary between the secondary color (blue) and the primary color (cyan), but the images were such that caused no problem in actual use.

(2) Fastness to Washing

After the printed fabrics for T-shirt with the transferred image obtained in the above-described manner were placed in a washing machine and washed for 2 minutes in tepid water of 30° C. and air dried, the transferred images were visually observed to evaluate them as to the fastness to washing in accordance with the following standard. The results are shown in Table 4.

A: Excellent;

B: Good;

C: Somewhat good;

D: Somewhat poor;

E: Poor.

TABLE 4

| | Fastness to washing | Remarks |
|---|---|---|
| Example 1 | C | — |
| Example 2 | B | — |
| Example 3 | B | — |
| Comparative Example 1 | E | Fuzzing was conspicuous at the surface of the fabric |
| Comparative Example 2 | D | The transfer layer was partially separated after the washing |
| Example 4 | B | — |
| Example 5 | A | — |
| Example 6 | A | — |
| Example 7 | A | — |
| Example 8 | A | — |

Example 9

Release paper (ST-60 OKT, trade name, product of LINTEC Corp.) one side of which had been subjected to a releasing treatment was used as a base material, and a coating formulation having the following composition was applied to the back side (the side subjected to no releasing treatment) of the base material by a bar coater method, so as to give a dry coating weight of 1 g/m$^2$. The thus-coated base material was dried at 80° C. for 1 minute in a drying oven to form a water-repellent lubricant layer.

Composition of Coating Formulation for Water-Repellent Lubricant Layer

Polydimethylsiloxane (TPR-6711, trade name, product of Toshiba Silicone Co., Ltd.;

solids content: 30%) 333 parts (solids content: 100 parts)

Catalyst (CM670, trade name; product of Toshiba Silicone Co., Ltd.) trace amount Toluene 200 parts.

A coating formulation having the following formulation was then applied to the surface on the releasing layer side (the side opposite to the water-repellent lubricant layer) of the release paper, on which the water-repellent lubricant layer had been formed as described above, by a bar coater method, so as to give a dry coating thickness of 50 μm. The thus-coated release paper was dried at 70° C. for 10 minutes in a drying oven to form a transfer layer, thereby producing an image-transfer medium according to this example.

Composition of Coating Formulation for Transfer Layer

Porous nylon particles (Orgasol 3501EXD NAT, trade name, product of Elf Atochem S.A.;

particle size: 10 μm) 55 parts

Ethylene-acrylic acid copolymer emulsion (Hitec E-8778, trade name, product of Toho Chemical Industry Co., Ltd.;

solids content: 25%) 180 parts (solids content: 45 parts)

N-Ethyl-o,p-toluenesulfonamide (Topcizer No. 3, trade name, product of Fuji Amide Chemical Co., Ltd.; solids content: 30%) 33 parts (solids content: 10 parts)

Silica particles (Mizukasil P-78A, trade name, product of Mizusawa Industrial Chemicals, Ltd.; particle size: 3 μm;) 2 parts Cationic resin (EL Polymer NWS-16, trade name, product of Shin-Nakamura Chemical Co., Ltd.; solid content: 35%) 23 parts (solids content: 8 parts)

Fluorine-containing surfactant (Surflon S-131, trade name, product of Seimi Chemical Co., Ltd.; solid content: 30%;) 3 parts (solids content: 1 part) Isopropyl alcohol 40 parts.

Example 10

A water-repellent lubricant layer was formed on the back side of the same release paper as that used in Example 9 in the same manner as in Example 9. A coating formulation having the following composition was then applied to the surface on the releasing layer side (the side opposite to the water-repellent lubricant layer) of the release paper, on which the water-repellent lubricant layer had been formed, by a bar coater method, so as to give a dry coating thickness of 20 μm. The thus-coated release paper was dried at 70° C. for 10 minutes in a drying oven to form a uniform film layer.

Composition of Coating Formulation for Uniform Film Layer

Porous nylon particles (Orgasol 3501EXD NAT, trade name, product of Elf Atochem S.A.;

particle size: 10 μm) 0.1 parts Ethylene-acrylic acid copolymer emulsion (Hitec E-8778, trade name, product of Toho Chemical Industry Co., Ltd.;

solids content: 25%) 400 parts (solids content: 100 parts) Isopropyl alcohol 5 parts.

A transfer layer was then formed in the same manner as in Example 9 on the uniform film layer of the release paper, on which the water-repellent lubricant layer and the uniform film layer had been formed, thereby producing an image-transfer medium according to this example.

Example 11

A coating formulation having the following composition was applied to the back side of the same release paper as that used in Example 9 by a bar coater method, so as to give a dry coating weight of 1 g/m$^2$. The thus-coated release paper was dried at 140° C. for 1 minute in a drying oven to form a water-repellent lubricant layer.

Composition of Coating Formulation for Water-Repellent Lubricant Layer

Silicone (SD7226, trade name, product of Toray Dow Corning Silicone Co., Ltd.;

solids content: 30%) 33 parts (solids content: 10 parts) Catalyst (SRX212, trade name; product of Toray Dow Corning Silicone Co., Ltd.) 0.03 parts Toluene 20 parts.

A transfer layer was then formed in the same manner as in Example 9 on the surface on the releasing layer side (the side opposite to the water-repellent lubricant layer) of the release paper, on which the water-repellent lubricant layer had been formed as described above, thereby producing an image-transfer medium according to this example.

Example 12

A water-repellent lubricant layer was formed on the back side of the same release paper as that used in Example 9 in the same manner as in Example 11. A coating formulation having the following composition was then applied to the surface on the releasing layer side (the side opposite to the water-repellent lubricant layer) of the release paper, on which the water-repellent lubricant layer had been formed, by a bar coater method, so as to give a dry coating thickness of 20 μm. The thus-coated release paper was dried at 70° C. for 10 minutes in a drying oven to form a uniform film layer.

Composition of Coating Formulation for Uniform Film Layer

Porous nylon particles (Orgasol 3501EXD NAT, trade name, product of Elf Atochem S.A.;

particle size: 10 μm) 0.1 parts Ethylene-acrylic acid copolymer emulsion (Hitec E-8778, trade name, product of Toho Chemical Industry Co., Ltd.;

solids content: 25%) 400 parts (solids content: 100 parts) Isopropyl alcohol 5 parts.

A transfer layer was then formed in the same manner as in Example 10 on the uniform film layer of the release paper, on which the water-repellent lubricant layer and the uniform film layer had been formed, thereby producing an image-transfer medium according to this example.

Example 13

A water-repellent lubricant layer was formed on the back side of the same release paper as that used in Example 9 in the same manner as in Example 11. A coating formulation having the following composition was then applied to the surface on the releasing layer side (the side opposite to the water-repellent lubricant layer) of the release paper, on which the water-repellent lubricant layer had been formed, by a bar coater method, so as to give a dry coating thickness of 50 μm. The thus-coated release paper was dried at 70° C. for 10 minutes in a drying oven to form a transfer layer, thereby producing an image-transfer medium according to this example.

Composition of Coating Formulation for Transfer Layer

Ethylene-vinyl acetate copolymer emulsion (Chemipearl V-300, trade name, product of Mitsui Petrochemical Industries, Ltd.;

solid content: 40%; particle size: 6 μm;) 137.5 parts (solids content: 55 parts)

Ethylene-acrylic acid copolymer emulsion (Hitec E-8778, trade name, product of Toho Chemical Industry Co., Ltd.;

solids content: 25%) 180 parts (solids content: 45 parts)

Silica particles (Mizukasil P-78A, trade name, product of Mizusawa Industrial Chemicals, Ltd.;

particle size: 3 μm;) 0.6 parts

Acrylic cationic resin (EL Polymer NWS-16, trade name, product of Shin-Nakamura Chemical Co., Ltd.; solid content: 35%) 6.8 parts (solids content: 2.4 parts) Water 10 parts.

Evaluation

Printing was conducted on the thus-produced image-transfer media of Examples 9 to 13 in accordance with a back printing film mode by means of an ink-jet color printer, BJC-600 (trade name, manufactured by Canon Inc.) to form an image on the transfer layer of each image-transfer medium. The image-transfer media on which the image had been formed was used to make evaluation as to the following items.

(1) Evaluation of Operation Feasibility on Transfer Printing

Each of the image-transfer media on which the image had been printed in the above-described manner was used to transfer its image to a T-shirt (100% cotton) by means of an iron, TA-FZ2 (trade name, manufactured by Toshiba Corporation; width: 110 mm). At this time, the image-transfer medium was evaluated as to operation feasibility on transfer printing (easy sliding of the iron, and the like). As a result, in all the image-transfer media, the slide of the iron was smooth, and so the transfer printing was able to be conducted smoothly.

(2) Evaluation of Image-Transfer Media as to Curling

Each of the image-transfer media produced in Examples 9 to 13 was placed under an environment of high temperature and high humidity (30° C., 80% RH) to measure the degrees of curling at side-ends of the image-transfer medium. The evaluation was conducted by measuring the degrees of curling at all of 4 corners as to 5 sheets of each image-transfer medium and averaging their values. The results are shown in Table 5.

TABLE 5

| | Degree of curling |
|---|---|
| Example 9 | 2 mm |
| Example 10 | 3 mm |
| Example 11 | 2 mm |
| Example 12 | 3 mm |
| Example 13 | 2 mm |

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image-transfer medium for ink-jet recording, comprising a base material, and a releasing layer and a transfer layer provided on the base material, wherein the transfer layer has fine particles of a thermoplastic resin, a thermoplastic resin binder, a cationic resin and inorganic fine particles, and the total content of the cationic resin and the inorganic fine particles falls within a range of from 3% to 20% by weight based on the total weight of the fine particles of the thermoplastic resin and the thermoplastic resin binder.

2. The image-transfer medium according to claim 1, wherein the fine particles of the thermoplastic resin are porous.

3. The image-transfer medium according to claim 1, wherein the fine particles of the thermoplastic resin are fine particles composed of a copolymer of a monomer of nylon 6 and a monomer of nylon 12.

4. The image-transfer medium according to claim 1, which further comprises a uniform film layer between the transfer layer and the releasing layer.

5. The image-transfer medium according to claim 1, wherein a weight ratio of the fine particles of the thermoplastic resin to the thermoplastic resin binder falls within a range of from 1/2 to 50/1.

6. The image-transfer medium according to claim 1, wherein a weight ratio of the inorganic particles to the cationic resin falls within a range of from 1/1 to 1/20.

7. The image-transfer medium according to claim 1, wherein the transfer layer comprises further a plasticizer.

8. The image-transfer medium according to claim 7, wherein the transfer layer contains 1.0 to 5.0% by weight of a fluorine-containing surfactant.

9. The image-transfer medium according to claim 1, which further comprises a water-repellent lubricant layer on the opposite side of the base material to the side on which the releasing layer is provided.

10. An image-transfer printing process comprising the steps of:

forming an image on the transfer layer of the image-transfer medium according to claim 1 in accordance with an ink-jet recording method, laying the image-transfer medium and a transfer-printing medium to overlap each other with the transfer layer on the side of the transfer-printing medium and heating them, and separating the base material of the image-transfer medium from the transfer-printing medium.

* * * * *